United States Patent [19]

Erni et al.

[11] Patent Number: 5,036,656

[45] Date of Patent: Aug. 6, 1991

[54] APPARATUS FOR BLOCK CHANGING IN A RING SPINNING MACHINE

[75] Inventors: Markus Erni; Peter Anderegg; Daniel Brennwalder, all of Winterthur, Switzerland

[73] Assignee: Maschinenfabrik Rieter AG, Winterthur, Switzerland

[21] Appl. No.: 462,780

[22] Filed: Jan. 10, 1990

[30] Foreign Application Priority Data

Jan. 10, 1989 [DE] Fed. Rep. of Germany ..... 3900507

[51] Int. Cl.[5] ..... D01H 9/18

[52] U.S. Cl. ..... 57/264; 57/281

[58] Field of Search ..... 57/261, 263, 264, 276, 57/281, 90; 242/36, 118.3, 118.32

[56] References Cited

U.S. PATENT DOCUMENTS

| | | | |
|---|---|---|---|
| 4,563,873 | 1/1986 | Tooka | 57/276 X |
| 4,609,915 | 9/1986 | Erkens | 242/36 X |
| 4,660,370 | 4/1987 | Matsui et al. | 57/281 |
| 4,676,442 | 6/1987 | Tholander et al. | 242/36 X |
| 4,771,597 | 9/1988 | Igel et al. | 57/264 |

FOREIGN PATENT DOCUMENTS

| | | | |
|---|---|---|---|
| 3527473 | 2/1987 | Fed. Rep. of Germany | 57/264 |
| 3635140 | 4/1988 | Fed. Rep. of Germany | 242/36 |
| 3730373 | 3/1989 | Fed. Rep. of Germany | 57/261 |
| 282060 | 11/1988 | Japan | 242/36 |

*Primary Examiner*—Joseph J. Hail, III

*Attorney, Agent, or Firm*—Burns, Doane, Swecker & Mathis

[57] ABSTRACT

An apparatus for carrying out a block-change in a ring spinning machine, in which a block of roving bobbins which each supply an associated spinning station are changed together when the rovings wound on the bobbins run out. Preferably, more than one block of roving bobbins is provided. The roving bobbins used to form a block are combined in such a manner that all of them have at least substantially the same length of roving wound on them. The end of the roving on at least one of the bobbins of the block is detected before that end passes through the associated drafting unit, and the block-change is triggered at an instant of time when the roving end has not yet passed through the drafting unit.

3 Claims, 3 Drawing Sheets

APPARATUS FOR BLOCK CHANGING IN A RING SPINNING MACHINE

FIELD OF THE INVENTION

This invention relates to a method and apparatus for carrying out a block-change in a ring spinning machine, in which a block of roving bobbins which each supply an associated spinning station are changed together when the rovings wound on the bobbins run out, the spinning machine preferably including a plurality of blocks of roving bobbins.

BACKGROUND OF THE INVENTION

At present bobbin changing on ring spinning machines is usually a random operation, meaning that roving bobbins are exchanged and replaced by new full bobbins only when empty or substantially empty, the exact position of the emptying bobbins not being known in advance but being distributed statistically over the whole length of the ring spinning machine.

However, random changing leads to lost output since discovering that a particular roving bobbin is empty, removal of this empty bobbin and insertion of a full bobbin takes some time. There is also some downtime since the operators are often not in a position to immediately change all of the bobbins which are becoming empty. Another cause of lost output is that the roving of a new full bobbin must first be led through the drafting unit and then connected to the trailing or running-out end of the ring-spun yarn produced from the previous bobbin.

To obviate this loss of time an apparatus has already been suggested which enables the trailing end of the roving to be connected automatically to the entering or leading end of the new roving. The aforementioned known apparatus is disclosed in published European Patent Application No. 296,546, the disclosure of which is incorporated herein by reference. The design of that known apparatus makes it easier to employ bobbin exchanging in blocks, i.e., a so-called block change, in accordance with the present invention.

OBJECTS AND SUMMARY OF THE INVENTION

It is the object of this invention to suggest a method of and an apparatus for the economic performance of a block-changing whereby downtimes and, therefore, losses of productivity are substantially obviated and handling of the empty and full roving bobbins is improved. It is another aim of the invention to ensure that the method and apparatus are well adapted for use with a computer-controlled ring spinning machine.

To solve this problem, in the method according to the invention, the roving bobbins used to form a block are combined in accordance with the criterion that all of them have at least substantially the same length of roving wound on them; in that the end of the roving is detected on at least one of the bobbins of the block before such end passes through the associated drafting unit; and in that block-changing is triggered at an instant of time when the roving end has not yet passed through the crafting unit.

A precondition for the block-change is therefore that all the roving bobbins are of the same size—i..e., have the same length of roving wound on them—for only thus can it be ensured that all of the bobbins of a block run out together. The invention provides at least two different methods of determining the end of the roving on at least one of the bobbins of the block. In the first variant of the method according to-the invention, the length of roving wound on at least one bobbin of the block is transmitted to a computer and stored. The speed of the roving entering the associated drafting unit or a value proportional to such speed is detected continuously and integrated or summated with respect to time to establish the unwound length of roving. The unwound length is subtracted from the stored value of the wound-on length, and the block-change is triggered at an instant of time when the calculated difference between the wound-on length and the unwound length is zero or substantially zero.

Consequently, the length of roving wound on at least one of the bobbins of the block can be transmitted to the computer by way of an input unit—i.e., by the operator who knows this length, for example, from corresponding documentation from the flyer where the full bobbin was prepared or, for example, because the length is indicated on the bobbin itself.

It is, however, even simpler if the length of roving wound on at least one of the bobbins of the block is transmitted automatically to the computer while the roving bobbin is being wound on the flyer. In that case, the roving bobbins must be distinguished by corresponding numbering.

An intermediate stage is possible wherein the length of roving wound on at least one of the bobbins of the block is applied to this bobbin by means of a corresponding machine-readable encoding. Preferably, the encoding is applied automatically after termination of the winding of the bobbin on the flyer. The encoding is then read mechanically and transmitted to the computer when the bobbin enters the magazine of the ring spinning machine. In all of these variants, therefore, the computer has available to it, for at least one bobbin of the block, information about the yarn length wound on this bobbin.

Through the determination of the speed at which the roving enters the drafting unit one obtains a value for the unwound length of roving which the computer can continuously subtract from the full roving length in order to determine the remaining length. When that value approaches zero, the computer can recognize this circumstance automatically and can be used to initiate the block-change. It is conventional for all the drafting units of a ring spinning machine to be driven by a common drive—i.e., at the same speed—so that it is unnecessary to determine the speed of roving movement separately for each drafting unit. Instead, this can be carried out somewhere in the ring spinning machine or even ascertained by or from the control of the drafting unit drive.

Measuring the speed of roving movement is not the only possibility. For example, an accurate prediction about the corresponding length of the roving drawn off the bobbin can be made by simply counting the revolutions of the drafting unit shaft. When the length of the wound-on roving is stored in the form of a number representing the-same unit of counting, the number obtained by counting can just be subtracted from the number corresponding to the full length of roving wound on the bobbin to ascertain the remaining length. Block-change can be initiated either when this number has decreased to zero or when it has reached a value of substantially. zero, but leaving a safety margin sufficient to ensure that the end of the roving which is running out has not already passed through the drafting unit when the end of the new roving arrives there.

Reference should be made here to U.S. Pat. No. 4,563,873 disclosing an apparatus wherein, in the rotor spinning field, the length of spun yarn produced from a sliver at a spinning station is continuously totalized and the run-out of the sliver is calculated from the calculated value of spun yarn length and the original length of the sliver disposed in a can and supplied to the rotor spinning station, and is indicated so that the can can be exchanged in sufficient time. Apart from the fact that this is not a block-change, the apparatus suffers from the disadvantage of inaccuracy since it is difficult to place the spun yarn length in an accurate relationship with respect to the original sliver length.

The present invention is free from the aforementioned disadvantage since measurements are always made relative to roving length and not to ring-spun yarn length.

The other possiblity according to the invention of detecting the end of the roving is that a machine-readable marking on the empty bobbins, preferably at the end of the first layer of turns, is detected mechanically and passed to the computer to trigger block-change.

Since the marking is disposed below the last layer of turns —i.e., the first layer with respect to the winding-on of the bobbin, the time until complete emptying of the bobbin can be determined very accurately and used to trigger, the necessary block-change.

In a special variant of the invention, the number of turns on the roving bobbin is detected during winding-on and, during unwinding of the bobbin in the ring spinning machine, a marking on the bobbin is monitored to determine the number of drawn-off turns, with the block-change being triggered on the basis of a comparison between the number of wound-on turns and the number of drawn-off turns. This system is relatively simple but very reliable. The roving frame can be devised so that only a predetermined number of turns is wound on the roving bobbin, such number being stored in the control of the ring spinning machine.

According to another feature of this invention, the time of the block-change can be determined in advance by the computer during unwinding from the already detected and stored values and this information can be used to control the disposition of other full roving bobbins to form a new block. It is therefore possible to ensure that new blocks of full bobbins are always available when block-changing is imminent. If the spinning plant is fully automated this information can also be used to ensure the timely return of empty bobbins to the flyer.

BRIEF DESCRIPTION OF THE DRAWINGS

The invention will be described hereinafter with reference to the accompanying drawings wherein like elements bear like reference numerals and wherein.

DETAILED DESCRIPTION OF THE PREFERRED EMBODIMENTS

Figure 1:
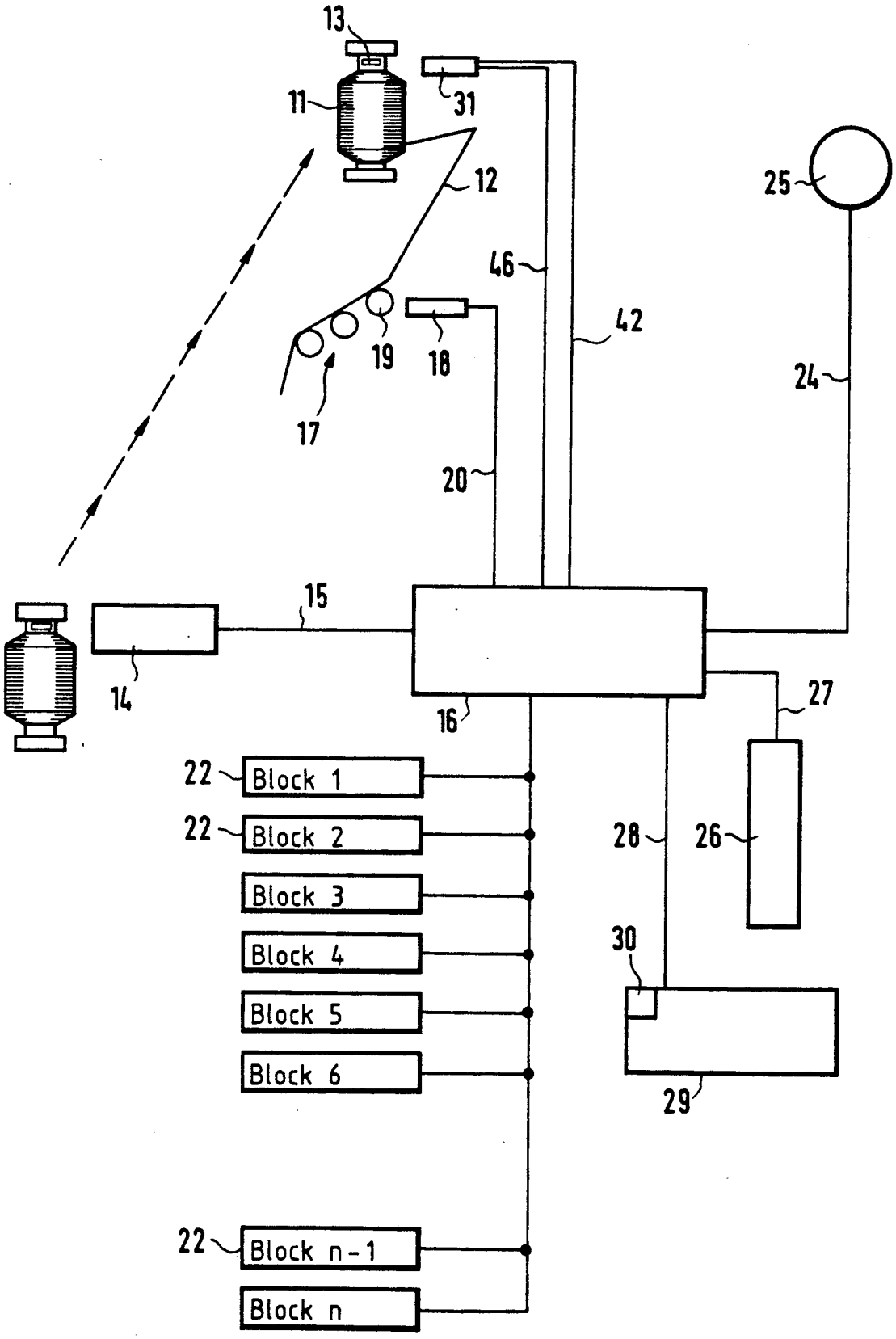
FIG. 1 is a diagrammatic view of the invention.

The starting point for the first embodiment of the method and apparatus according to the invention is that the length of roving 12 wound on a roving bobbin 11 is known and is retained on the bobbin by an appropriate magnetic coding 13. This magnetic coding can be of a conventional kind such as is used, for example, in the magnetic strip of a credit card. The information contained in this coding concerning the length of wound-on roving 12 is entered on the magnetic strip, for example, when the bobbin leaves the flyer, on the basis of values measured therein.

In flyers designed so that the same length of roving can always be provided on the roving bobbins, there is no need to grade the roving bobbins by length. In the absence of such criteria, in a preliminary stage of the method according to the invention, bobbins having substantially the same lengths are pregraded into blocks and one bobbin, preferably the one having the shortest yarn length, can then be used as the "lead bobbin".

The magnetic coding can be read at any time, for example, upon leaving the roving frame, during a wait in the magazine prior to formation of the block or after formation thereof on the ring spinning machine itself, depending on whether all the lengths are or are not equal. In the present example it is assumed that all of the roving bobbins have the same wound-on length so that no difficulties arise in making up the blocks, and the wound-on length of roving is first detected at the ring spinning machine itself, detection being by means of a magnetic reader 14 which reads the magnetic coding. The roving length read out by this magnetic reader or this reading head is passed via a line 15 to a computer 16. The roving or sliver 12 then enters a drafting unit 17 and is connected to the running-out end of the roving of the previous roving bobbin by way of a double condenser known from the published European patent application 296 546, the disclosure of which is incorporated hereby by reference. After the roving has entered the drafting unit an initiator or tachometer 18 in the entry roller 19 of the drafting unit detects the speed of entry of the roving into the drafting unit. This entry speed corresponds to the speed of unwinding of the roving from the roving bobbin. This unwinding speed is passed via line 20 to computer 16. The computer integrates such speed with respect to time by means of the timer (clock) in the computer and thus forms from the signals received from the initiator a continuously increasing number corresponding to the unwound length of roving. If the initiator is just a counter counting the revolutions of the entry roller then the count value itself can be used as the unit of length for the unwound length of roving.

The computer has a length memory 22 for each block of the ring spinning machine, that is, the blocks 1 to n, each block consisting, for example, of six roving bobbins. The complete roving length of the roving bobbins momentarily present in such block is stored in each length memory 22. The computer subtracts for each block the value for the drawn-off roving length from the originally present complete roving length and thus forms a residual value or remainder which is monitored by the computer.

It should be pointed out here that computer requires only a single initiator and only a single magnetic reader since the ring spinning machine shown is one in which all the drafting units are driven at the same speed. Should this not be the case, something which would be unusual but definitely possible, a separate initiator must be provided for each drafting unit or for each group of drafting units. Only a single magnetic reader need be provided since each encoding is read out at a different time. Sufficient time is available for all the arriving roving bobbins to be read before being taken into use.

When the computer detects for one of the blocks that the yarn end has been reached or only a predetermined residual length of roving is present, the computer passes a signal via line 24 to a unit 25 which triggers block-changing of the bobbins in that block by way of the double condensers, as these are described in the published European patent application 296 546, the disclosure of which is incorporated herein by reference.

FIG. 1 shows three other possibilities for inputting the roving lengths marked on the roving bobbins. The block 26 represents one input unit enabling the operator to input data specific to the flyer to the computer via line 27.

Line 28 extends to a flyer 29 which is shown as a block and which has a device 30 which measures the wound-on roving lengths while the roving bobbins are actually being manufactured and the winding process supplies a corresponding signal via line 28 to computer 16.

Finally, FIG. 1 shows a photodetector 31 which detects a marking or raster on the roving bobbin. More details of this feature will be understood from FIG. 2.

Figure 2:
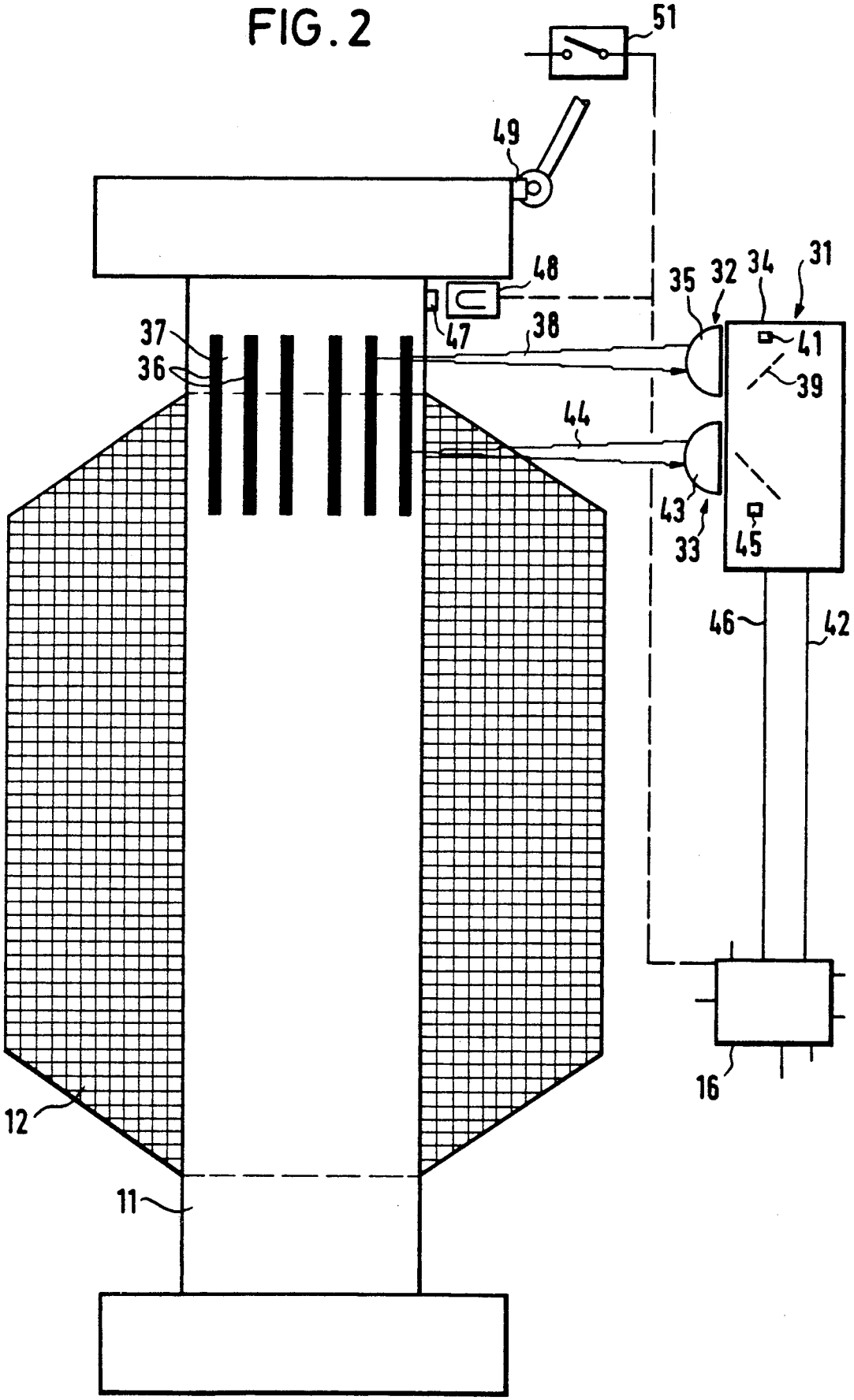
FIG. 2 is a perspective view of a photodetector for detecting a marking on the roving bobbin.

As FIG. 2 shows, the sensor 31 comprises two light barriers 32, 33 disposed one above another. A light source in photosensor housing 34 emits a light beam 38 through a front lens 35 towards the roving bobbin where, depending upon the position thereof, the beam 38 strikes either a black marking 36 or a blank zone 37 disposed between the markings 36. When the beam 38 strikes a black marking, the light is absorbed and no light returns to the photodetector. When the light strikes an empty zone, it is scattered and some returns to the lens 35 which deflects it in the housing of the photosensor 31, by way of a dividing mirror 39 or the like, to a photoreceiver 41. The signal of the photoelectronic receiver 41 is then supplied by way of line 42 to computer 16. The photosensor 31 also comprises a second lens 43 which directs light from the same source in the form of a beam 44 to a zone of the roving bobbin which is normally covered by the roving 12. The light barrier 33 containing the second lens 43 has its own photoreceiver 45 and can have its own light source. The photoreceiver 45 of the second light barrier 33 is connected by way of an independent line 46 to the computer 16. When the final layer of the roving has been reached and a start has been made on unwinding it, the second part of the marking 36 is exposed and is detected by the second light barrier 33, and a further pulsating signal is produced and is supplied by way of the line 46 to the computer 16. Upon receipt of this further signal the computer knows that the roving will shortly end and the computer also knows that the length remaining until complete unwinding of the roving. Taking account of the working speed of the ring spinning machine the computer 16 can now calculate relatively accurately the time at which the roving will run out and it can initiate block-changing as previously described by way of the line 24 and unit 25.

It is not absolutely essential to use two light barriers; it is sufficient to use just that light barrier which scans the normally covered zone of the marking. However, it is preferred to use two light barriers since the presence of the signal of the top photodetector gives a clear indication that the roving has not broken. Should the roving break, the roving bobbin ceases to rotate since roving ceases to be drawn off. The photoreceiver 41 therefore produces no alternating signal, something which the computer detects by way of the line 42 and which it evaluates as a break of the roving. If two light barriers are used with just a single light source, the evaluation of the signal of the photoreceiver 41 gives clear proof that the light source is in order.

The marking 36, which at its simplest can be a single line, can be used to detect the number of revolutions of the roving bobbin during unwinding. This enables the number of turns unwound from the bobbin to be counted by the computer and to be compared with the number of turns originally wound on the bobbin.

The number of turns originally wound on the bobbin is given by the speed difference between the flyer of the flyer frame and the roving bobbin during winding-on on the flyer frame. Means other than the marking 36 can be used for this purpose. For example, a magnet 47 can be provided on the roving bobbin and at each rotation thereof induce a corresponding voltage in a detecting loop 48, or a cam 49 can operate a switch 51. In either case the corresponding signal is supplied to the computer 16 once per revolution of the tube.

At the first creeling-up of the ring spinning machine the roving bobbins of the inner row must be smaller by about half the length of a bobbin than the roving bobbins of the outer row. The reason for this is that in a manner known per se, the rovings of two bobbins are supplied to a drafting unit, that is, from a bobbin in the inner row of bobbins and from a bobbin in the outer row of bobbins. The result of using half-bobbin lengths in the inner row at the first creeling-up is that in subsequent operation of the ring spinning machine the bobbins of both rows become empty at different times, something which is desirable. After the first creeling-up, roving bobbins of the same length are always used.

When sensors are used which count bobbin rotations or detect markings on the bobbins, two sensors are preferably provided so that in the event of a roving break on a bobbin associated with one of the sensors, the signal of the other sensor still remains available to determine the block-changing time.

In order to be able to meet each customer's wishes, ring spinning machines which are intended for block change should likewise be usable with the random change. It has now been recognized, in accordance with the invention, that this is also possible, particularly since the double condenser arrangement can be straightforwardly used for the random change.

One can first of all imagine the arrangement such that blocks are again formed but with each block containing only one bobbin. Since, during random change of the flyer bobbins on the ring spinning machine, the bobbins run out in a "disordered" fashion, the control computer must be able to know the state (degree of unwinding) of at least half of all the bobbins which are in production. One primarily thinks of solutions in which the state of each bobbin is monitored by means of an optical or mechanical sensor. Since, for a machine with 1000 spinning stations, 500 bobbins must be monitored by means of sensors, such solutions would be correspondingly expensive.

Accordingly one is looking for a solution in which all the bobbins of the ring spinning machine can be monitored by means of one or relatively few sensors. This solution is satisfactory because it represents the most economical solution and can be rapidly realized.

Various possibilities exist for realizing the coupling of the roving which is about to run out with the new roving in the double condenser.

Figure 3:
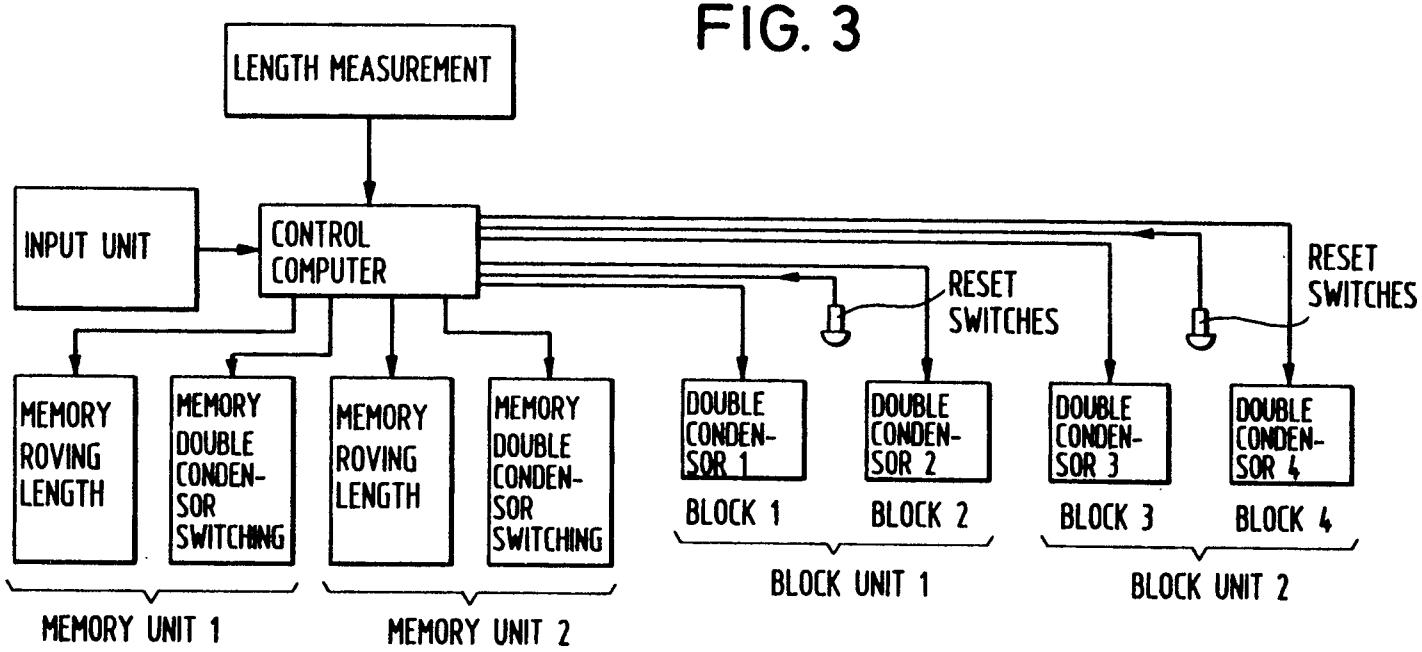
FIG. 3 is a schematic representation of the computer arrangement for executing a random change.

As already mentioned above, the length of roving unwound from the spools during production on the ring spinning machine can be measured by means of an initiator or a tachometer. The degree of unwinding of the bobbins of a block (one bobbin during random change) is stored in a computer and is kept up to date via the length measurement. A schematic block circuit diagram for the realization of this proposal during random change is shown in FIG. 3. For this purpose a double condenser is provided for each block. For block change, the block scheme shown in FIG. 3 would be changed so that the double condensers 1, 3, 5 etc. and 2, 4, 6 etc. are combined into one block. A memory unit is also provided for each block unit. The input unit shown in the block diagram in FIG. 3 consists of a central panel on the ring spinning machine and serves for the input of the lengths of roving that are supplied, for the input of data in connection with an impending change of the type of yarn and for introducing start up and run down spinning procedures.

The memory unit reads into the memory the roving length which is fed in via the input unit and which is reduced by the factor 0.5, i.e., the length of roving on the roving bobbin. Via the length measurement the roving length of the bobbin is kept up to date while the machine is running, i.e., the memory knows how much material is present on the bobbin. This takes place as previously explained. If the value zero (equal to the tolerance) is achieved in the memory for the "roving length" then the control initiates the coupling at the relevant double condenser. The memory "double condenser switching" provides the control with the information as to which double condenser of a block unit is about to execute the next coupling procedure.

For the block units two blocks cooperate in each block unit (two double condensers during random change) and one memory unit is required for each block unit.

For the random change a reset switch is required for each two double condensers. If the switch is actuated, then the two memories of the memory unit are read in anew. During start of spinning, the control now knows that the relevant block unit has started production and that the left hand double condenser of the block unit must be the first to couple.

The block size can vary from one double condenser (random change) up to a maximum of half of all the spinning stations.

Figure 4:
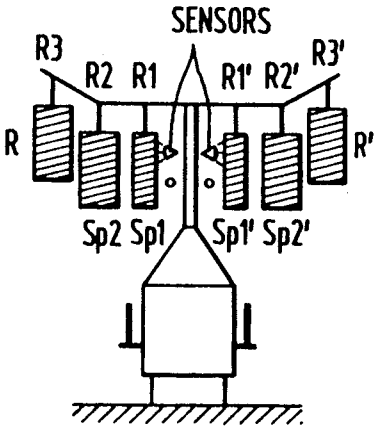
FIG. 4 is a schematic representation of two spinning stations arranged on opposite sides of a ring spinning machine as seen in the longitudinal direction of the ring spinning machine.

A further possibility for initiating the coupling of the two rovings in the double condenser lies in monitoring the bobbins. In the present variant, which is schematically illustrated in FIG. 4, the bobbins are monitored with optical or mechanical sensors, i.e., a control is made as to how much roving is located on the bobbin. If the permissible degree of unwinding of a bobbin is exceeded then the control initiates the coupling process at the relevant double condenser. In FIG. 4 SP1, SP1' represent bobbins which are monitored by sensors. SP2 and SP2' are non-monitored bobbins which are in production. In contrast, R, R' are reserve bobbins.

During random change all bobbins at the positions R1 and R1' are monitored with sensors.

In contrast, during block change two bobbins (guide bobbins) per block are monitored, as previously explained.

The sensors illustrated here are the sensors of FIG. 2, i.e., the flyer bobbins are equipped with a raster foil which is always visible and with a reflector foil which is not visible when the bobbin is full. A check is made via the raster foil with an optical sensor whether the bobbin is turning. If the bobbin does not turn for a longer period of time then a roving break has occurred. In this case the second guide bobbin takes on the initiation of the coupling. Should a roving break also occur with this bobbin then this is indicated to the operating personnel either optically or acoustically. If the reflector foil becomes visible on the bobbin then the control initiates the coupling procedure.

For the curing of a roving break at a guide spindle the "normally" run out bobbin of a neighboring spinning location can be set in place of the guide bobbin.

For random change it is also possible to integrate an optical or mechanical sensor in each double condenser to monitor the production roving. If a roving break occurs, or if the production roving runs out then the prepared reserve roving is automatically set in operation. In distinction to the previously described variants the production roving is not separated by the double condenser but rather runs out. This has the advantage that no residual roving remains on the bobbin and this does not therefore have to be removed.

The ring spinning machine can operate as follows. With reference initially to FIG. 4, when the ring spinning machine is initially started, the roving bobbins Sp1, Sp1' in the positions R1, R1' have a length of roving wound thereon that is half as long as the length of roving wound on the roving bobbins located at the positions R2, R2' and R3 and R3'.

When the bobbins Sp1, Sp1' at the positions R1, R1' become empty, the bobbins Sp2, Sp2' located at the positions R2, R2' are half empty and are slid along the rail into the positions R1, R1', respectively. Similarly, the reserve bobbins R, R1' are also half empty and are moved from the positions R3, R3' to the positions R2, R2'. Further, new reserve bobbins are placed at the positions R3, R3'. Thus, the bobbins at the positions R1 and R1' once again contain rovings that are half as long as the rovings on the bobbins in the positions R2 and R2' and the rovings on the new reserve bobbins at the positions R3 and R3'. It can be seen, therefore, that the bobbins in the positions R1 and R1' will always run out first. Accordingly, if the sensors shown in FIG. 4 are used to monitor when the roving bobbins run out, it is always the signals from those sensors which are required to trigger the change-over to the reserve roving from the reserved bobbins in the double condensers. Further, if those sensors are relied upon to determine when the roving bobbins are about to run out, the sensors only need to be provided for the roving bobbins in the positions R1 and R1', thereby reducing the number of sensors needed.

It is also possible, knowing the length of roving on each of the individual roving bobbins, to first measure the length of roving unwound from the inner bobbins at the positions R1 and R1' and then to assume that the same length of roving has been unwound from the outer roving bobbins located at the positions R2 and R2'. That assumption is justified in view of the fact that the unwound length of roving from the bobbins is determined by the length of roving that passes through the drafting unit which, of course, is the same for all of the bobbins. When the bobbins Sp2 and Sp2' move into the positions R1 and R1', the computer associated with the ring spinning machine can continue counting the length of roving withdrawn until it reaches a value that is close to the length of roving present on the bobbins Sp2 and Sp2', whereupon switching of the double condenser for changing over to the reserve bobbins is effected. In that way, by knowing the length of roving wound on each of the bobbins and the length of roving unwound from the bobbins located in the positions R1 and R1', the computer will be able to determine the length of roving remaining on the bobbins that move into the positions R1 and R1' from the positions R2 and R2'.

It can be readily seen that the double condensers initially associated with the bobbins Sp1 and Sp1' couple the beginning of the roving on the reserve bobbins R and R' with the ends of the rovings on the empty bobbins Sp1 and Sp' and then when the bobbins Sp2 and Sp2' move into the positions R1 and R1', it will be necessary for the computer to switch over to the other double condenser for coupling the beginning of the new reserve roving bobbins in positions R3 and R3' to the ends of the rovings on the bobbins Sp2 and Sp2' when those latter bobbins are empty. For this reason, the diagram of FIG. 3 shows each memory unit (i.e., memory unit 1 and memory unit 2) as comprising a memory for the roving length and a memory for the double condenser switching because such information is needed for each pair of roving bobbins (i.e., pair Sp1 and Sp2, pair Sp1' and Sp2', etc.).

Thus, as seen in FIG. 3, each roving bobbin forms its own block. For example, roving bobbin Sp1 forms block 1, roving bobbin Sp2 forms block 2, roving bobbin Sp1' forms block 3, roving bobbin Sp2' forms block 4, etc. However, block 1 and block 2 can also be regarded as a block unit comprising, for example, the roving bobbins Sp1 and Sp2 (block unit 1) or Sp1' and Sp2' (block unit 2).

The reset switches in FIG. 3 take account of the fact that with block units consisting of single roving bobbins, the ring spinning machine will not be automatically loaded with roving bobbins, but will be loaded by hand. That is to say, an operator will mount three bobbins such as Sp1, Sp2 and R in a row, will feed the roving from the bobbins Sp1 and Sp2 through the drafting unit, will thread the rovings onto two corresponding sleeves at the spinning positions and will then press the reset switch so that the memory for length is set to zero as soon as that position starts spinning. At the same time, the computer receives an indication that the left hand double condenser will be the first to switch to a reserve bobbin, since the left hand double condenser is associated with the inner roving bobbin which will run out first. The operator then moves to the next set of positions along the ring spinning machine and repeats the foregoing operation. To avoid unnecessary production losses, individual bobbins are taken into spinning operation as soon as they have been set in place and threaded through to the spinning positions.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others without departing from the spirit of the present invention. Accordingly, it is expressly intended that all such variations and changes which fall within the spirit and the scope of the present invention as defined in the claims be embraced thereby.

What is claimed is:

1. An apparatus for block-changing bobbins in a ring spinning machine, wherein the ring spinning machine includes at least one block containing a plurality of roving bobbins, each of the roving bobbins having a substantially equal length of roving wound thereon and each of the roving bobbins supplying a roving to an associated spinning station via respective drafting units, the apparatus comprising:

determining means for determining when the end of the roving on at least one of the roving bobbins in said at least one block has been reached after said at least one roving bobbin has been unwound; and initiating means for initiating changing of the at least one block with a new block containing full roving bobbins when said determining means determines that said end of said roving on said at least one roving bobbin has been reached, said at least one roving bobbin having a machine-readable first marking located thereon that is detectable when the roving is almost completely unwound and a machine-readable second marking located thereon that is not normally covered by the wound-on roving, said determining means including first and second detector units, said first detector unit detecting the first marking and said second detector unit detecting said second marking, said first and second detector units being connected by way of a common detector circuit arrangement to a control means for controlling said initiating means.

2. An apparatus according to claim 1, wherein said first and second markings include a plurality of spaced apart dark lines and said first and second detector units include optical readers.

3. An apparatus for determining when a roving bobbin wound with a roving is about to run out, comprising:

first sensor means for producing an output signal based o detection of a first marking on said roving bobbin;

second sensor means for producing an output signal based on detection of a second marking on said roving bobbin which is normally covered by the wound roving but which is uncovered when said roving is almost completely unwound; and evaluation means for evaluating said output signal from said first sensor means to determine whether said roving bobbin is turned and thus, whether said roving has broken, and for evaluating said output signal from said second sensor means to determine when the roving is unwound from the roving bobbin.

* * * * *